US005573385A

United States Patent [19]

Chevallier

[11] Patent Number: 5,573,385

[45] Date of Patent: Nov. 12, 1996

[54] DUAL CHAMBER PUMP

[75] Inventor: Yves Chevallier, La Garenne Colombes, France

[73] Assignee: Asti SAE, Courbevoie, France

[21] Appl. No.: 480,980

[22] Filed: Jun. 7, 1995

Related U.S. Application Data

[63] Continuation of Ser. No. 63,626, May 19, 1993, Pat. No. 5,480,292.

[51] Int. Cl.[6] ..... F04B 15/04

[52] U.S. Cl. ..... 417/393; 417/473; 417/454; 417/DIG. 1

[58] Field of Search ..... 417/473, 454, 417/DIG. 1, 393, 394, 395

[56] References Cited

U.S. PATENT DOCUMENTS

| | | | |
|---|---|---|---|
| 862,867 | 8/1907 | Eggleston | 417/390 |
| 3,829,248 | 8/1974 | Bright et al. | 417/410 |
| 4,252,510 | 2/1981 | Bromley | 417/534 |
| 4,480,969 | 11/1984 | Credle, Jr. | 417/393 |
| 4,708,601 | 11/1987 | Bazan et al. | 417/393 |
| 4,817,503 | 4/1989 | Yamada | 92/98 R |
| 4,836,756 | 6/1989 | Fukomoto | 417/394 |
| 4,867,653 | 9/1989 | Mills et al. | 417/360 |
| 5,021,151 | 6/1991 | Yane | 210/167 |
| 5,055,007 | 10/1991 | Geddings | 417/393 |
| 5,108,270 | 4/1992 | Kozumplik, Jr. | 417/393 |
| 5,141,412 | 8/1992 | Meinz et al. | 417/473 |
| 5,165,866 | 11/1992 | Kato | 417/360 |
| 5,308,230 | 5/1994 | Moore | 417/473 |

FOREIGN PATENT DOCUMENTS

| | | |
|---|---|---|
| 0410394 | 1/1991 | European Pat. Off. . |
| 0022379 | 12/1915 | France . |
| 2542392 | 3/1977 | Germany . |
| 8404363 | 11/1984 | WIPO . |

OTHER PUBLICATIONS

Sales Brochure—Furon Fluid Handling Products© Furon Co. USA.

Sales Brochure—Iwaki Walchem Pumps USA.

Sales Brochure—MD Magnetic Drive Pumps, Iwaki Walchen Corp. Walchen Corp. USA.

Sales Brochure—Furon Chempure Series Teflon© Pumps USA.

Sales Brochure—WILDEN Pumping Solutions Teflon© Diaphragms.

Sales Brochure—WILDEN Pump & Engineering Company.

Product Brochure—Application Profile, DU PONT.

*Primary Examiner*—Richard E. Gluck

*Attorney, Agent, or Firm*—Townsend and Townsend and Crew LLP

[57] ABSTRACT

The present invention provides an improved design for a mechanical pump. The pump is a dual chamber design typically including a pair of expandable bellows driven in a reciprocating fashion by a supply of pressurized air. The use of expandable bellows reduces wear on the pump thereby lengthening the required maintenance intervals in comparison with dual chamber diaphragm pumps previously known. Additionally, the pump is easily disassembled for inspection, cleaning or maintenance. Furthermore, the high strength of the pump's design makes it possible to manufacture the pump entirely of corrosion resistant materials.

19 Claims, 2 Drawing Sheets

DUAL CHAMBER PUMP

This is a continuation of application Ser. No. 08/063,626 filed May 19, 1993, now U.S. Pat. No. 5,480,292.

BACKGROUND OF THE INVENTION

1. Field of the Invention

The present invention relates generally to apparatus for pumping fluids. More specifically, the invention provides a simple and compact design for a reciprocating, dual-chamber, compressed air driven pump. The strength of the pump's design facilitates making the pump entirely of corrosion resistant materials.

2. Description of the Background Art

Dual chamber diaphragm pumps are known in the art. Pumps of this type are described in U.S. Pat. No. 4,708,601 to Bazan et al, U.S. Pat. No. 4,817,503 to Yamada, and U.S. Pat. No. 5,108,270 to Kozumplik, Jr. The pumps disclosed in these patents are pumps in which air pressure drives a pair of flexible diaphragms. Each diaphragm draws fluid through an inlet into a pumping chamber and forces the fluid out through an outlet as the diaphragm moves back and forth inside the pump. Such pumps have found widespread use pumping a diverse variety of fluids including water, chemicals, food products and other materials.

Known diaphragm pumps often have complicated designs including small metal fittings and fasteners. These complicated designs hinder disassembly and reassembly of the pumps. This makes routine maintenance and overhaul somewhat difficult. It would be desirable, therefore, to provide an improved pump design that would require less frequent maintenance. It would be further desirable to provide a simpler pump design allowing for convenient disassembly and reassembly to make required maintenance easier to perform.

Some dual chamber diaphragm pumps are adapted to pump corrosive fluids. These fluids would attack and corrode the metal parts commonly used in pumps designed for less demanding applications. In these pumps, some or all of the parts that normally come into contact with the pumped material (the wetted parts) are formed of or coated with chemically inert materials. U.S. Pat. No. 4,817,503 and 5,108,270 (mentioned above), as well as U.S. Pat. No. 4,867,653 to Mills et al, describe pumps having some parts formed of corrosion resistant materials.

However, even those pumps whose wetted parts are formed of or coated with corrosion resistant materials almost invariably include some metal parts in other, exterior locations. In many cases metal parts are used as fasteners and fittings to hold the pump bodies and associated tubing together. This is presumably because metal parts are significantly stronger and more easily machined than are corrosion resistant parts, which are typically made of some type of soft (relative to metal) plastic.

Pumps having exposed metal parts only in exterior locations not normally contacted by the pumped fluids are acceptable in many applications. However, such pumps have proven problematic in semiconductor manufacturing applications. These applications are doubly demanding in that extreme purity must be maintained in highly corrosive chemicals including a range of solvents and acids.

No matter how much care is used, it is virtually impossible to completely prevent leakage from a pump in a manufacturing operation. Small quantities of leaked chemicals will eventually contact the exposed fasteners and other metal parts of known pumps. When this occurs, the metal parts corrode and the dissolved corrosion products may leach back into the pump and contaminate the system. In most applications this is not critical—the contaminant quantities are relatively small and ultrapure chemicals are not absolutely essential.

In semiconductor manufacturing, however, even tiny amounts of contamination may be disastrous. Currently, electronic components are fabricated by the millions on single silicon chips and those chips are manufactured in large numbers in automated production runs. Chip failures due to contamination are not typically detected until the individual chips are tested after the manufacturing operation is complete. Under these circumstances, a single source of corroded metal leaking back into the fluid system may cause the loss of many thousands of dollars worth of product. Furthermore, expensive delays occur while the production line is shut down until the source of contamination can be located and the system purged. For these reasons, it would be highly desirable to provide an improved design for a pump in which all parts, inside and out, are made entirely of corrosion resistant materials.

SUMMARY OF THE INVENTION

The present invention provides an improved design for a dual chamber pump. According to one aspect of the invention, a pair of expandable bellows driven by a supply of compressed air replace the flexible diaphragms used in known pumps. The use of expandable bellows increases the volume of fluid pumped on each stroke and the pumping frequency can be reduced accordingly. This significantly decreases wear on the bellows, internal seals and other parts of the pump. Service intervals are thereby lengthened considerably in comparison with dual chamber diaphragm pumps previously known. Additionally, in fluid pumped by a bellows pump, the pressure pulsations are of lower frequency and amplitude than in fluid pumped by a diaphragm pump.

According to another aspect of the invention, the pump is assembled according to a novel design that is simple and of high strength. In this design a pair of rotatable rings mounted to the central core of the pump secure a pair of driven members and pump body members to the central core. In combination, the driven members and pump body members define a pair of pumping chambers through which fluid is pumped. Although this new design may find use even in pumps using flexible diaphragms as driven members, preferred embodiments will use the pair of expandable bellows referred to above. In another aspect of the improved design, inlet and outlet tubes for the flow of pumped fluid are secured to the pump by sets of rotatable tube locking rings.

The simplicity of the design is advantageous in that the pump is easy to disassemble and reassemble for inspection, cleaning or maintenance. The high strength of the design is also advantageous, particularly because it enables the pump to be made entirely of highly corrosion resistant materials, typically organic polymers. This will be especially desirable in demanding applications—such as those encountered in the semiconductor industry—in which pumps are used with highly corrosive materials whose purity must be strictly maintained.

BRIEF DESCRIPTION OF THE DRAWINGS

Understanding of the invention will be facilitated by reference to the following figures in which common reference numbers are assigned to equivalent parts in all views.

DESCRIPTION OF SPECIFIC EMBODIMENTS

Figure 1:
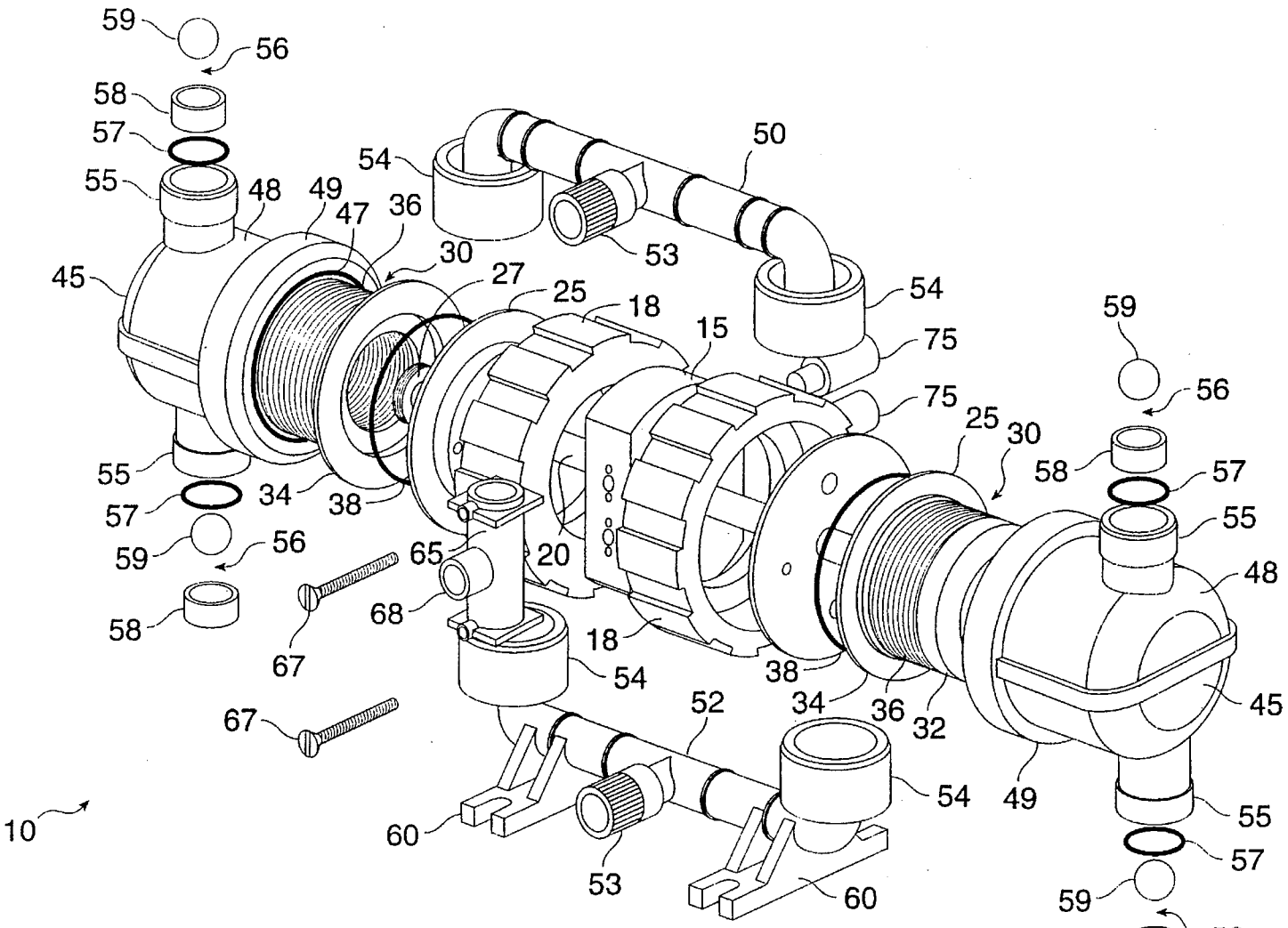
FIG. 1 is an exploded view showing a pump constructed according to the present invention.

A pump according to the invention is shown in an exploded view in FIG. 1. As can be seen therein, pump 10 is generally symmetrical with equivalent parts assembled on each side of a central pump core 15. For clarity, the assembly of only one side of the pump will be described; it should be understood that the other side is substantially equivalent. Understanding of the pump's construction will be aided by frequent cross referencing to FIG. 2. As is customary, equivalent parts are given the same reference numbers in both views.

Referring principally to FIG. 1, pump 10 is assembled around pump core 15. A rotatable body ring 18 is held in place against the pump core by a back plate 25. Back plate 25 is fixed to the pump core by plastic screws (not shown), which pass through the back plate into the pump core. The body ring is rotatable about a central axis passing through the pump core.

A pump shaft 20 is slidably disposed through pump core 15. Pump shaft 20 slides through four small s 22 (FIG. 2), which provide a seal between the shaft and pump core 15. FIG. 1 shows a series of parallel lines running the length of pump shaft 20. These lines are intended to indicate the cylindrical shape of the shaft and were generated by the computer drawing program used to produce FIG. 1. It should be understood that pump shaft 20 is in reality smooth along its length so that a positive seal is maintained between the shaft and O-rings 22 (FIG. 2).

Pump shaft 20 also extends through back plate 25. Back plate 25 will form a back surface for an air pressure chamber as will be described further below. The ends 27 of pump shaft 20 are typically of larger diameter than the rest of the shaft as seen in FIG. 2. The left end 27 of pump shaft 20 can also be glimpsed on the left side of the pump in FIG. 1. Again, the parallel lines on the end of the shaft in FIG. 1 are an artifact of the drawing program used to prepare FIG. 1. In reality, the ends 27 of pump shaft 20 are provided with external threads 28 (FIG. 2) for engagement with driven members 30.

Figure 2:
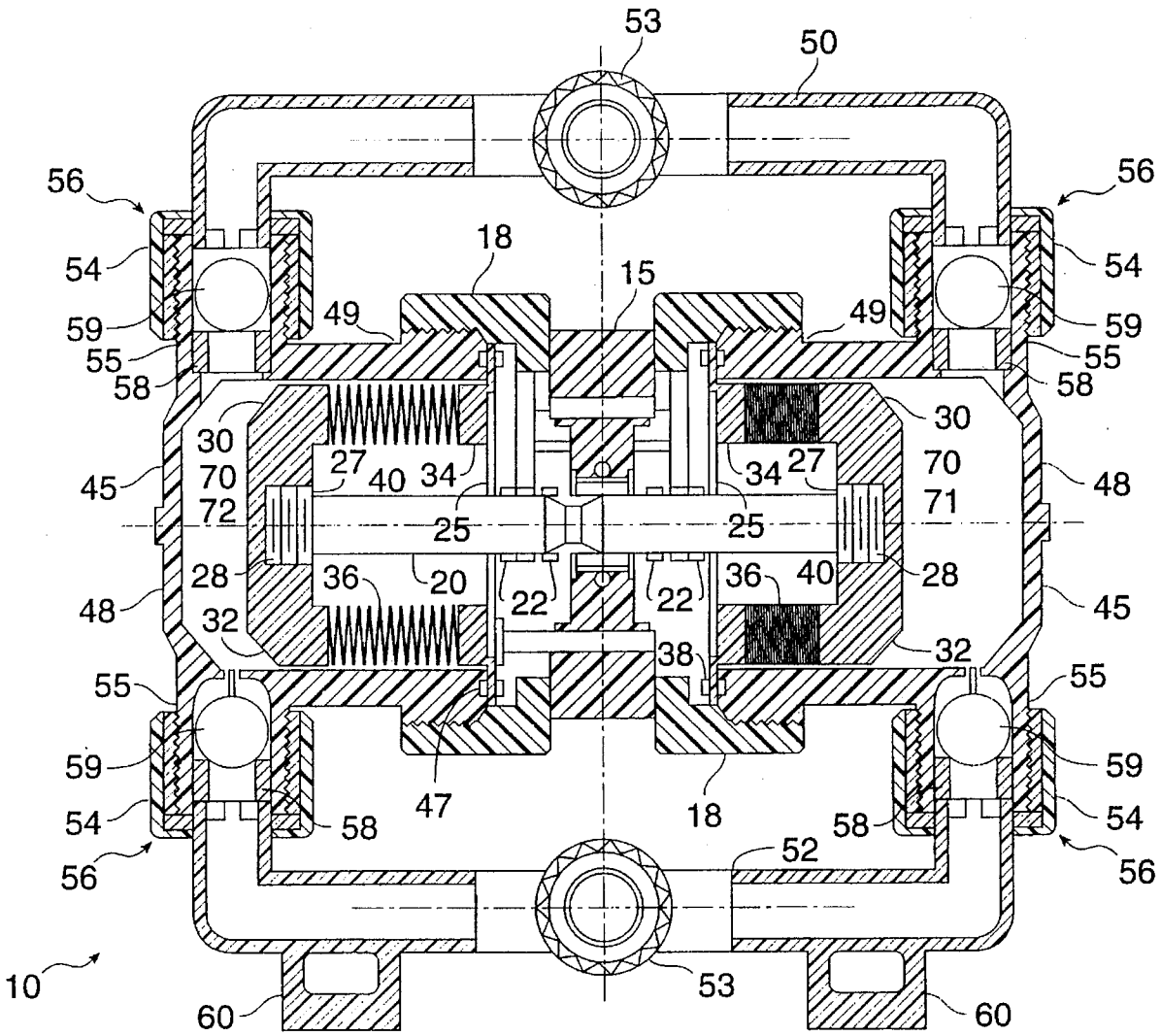
FIG. 2 is a side sectional view showing the interior of the pump.

The driven members can be seen in both FIG. 1 and FIG. 2. Driven member 30 is a generally cup-shaped body comprising an end cap 32 (FIG. 1) and a flange-shaped base 34 joined by an expandable bellows 36. The base 34 of driven member 30 is held against back plate 25 as will be described further below. A seal is maintained between the driven member and the back plate by an O-ring 38. In combination, back plate 25 and the interior of driven member 30 define a pressure chamber 40 (FIG. 2) in which air pressure drives the expansion of bellows 36.

The end caps 32 of driven members 30 are fixed to pump shaft 20 by means of a threaded connection 28 (FIG. 2) at the ends 27 of the shaft. The base 34 of each driven member 30 is secured to pump core 15. As the expandable bellows 36 of one driven member 30 expands, the other bellows is pulled into compression by pump shaft 20. In FIG. 1 and FIG. 2, the expandable bellows on the left side of the pump is shown expanded while the expandable bellows on the right side of the pump is shown compressed.

A pump body member 45 fits over driven member 30 with a seal maintained between them by O-ring 47, which can be seen in FIG. 2 and on the left side of the pump in FIG. 1. As can best be seen in FIG. 1, pump body member 45 comprises a dome 48 and a base 49. External threads (not shown) around the rim of the base engage with internal threads on body ring 18. Rotation of the body ring firmly secures base 49 of body member 45 over the flange-shaped base 34 of driven member 30. Thus, body member 45 and driven member 30 are both secured to the pump by body ring 18. When maintenance or inspection is necessary, body member 45 can be released simply by rotating body ring 18. Driven member 30 may then be removed by unscrewing it from the threaded end 27 of shaft 20.

An outlet tube 50 and an inlet tube 52 are each attached to the exterior of the body members. Each tube has a central connection 53 and a tube locking ring 54 at each end. Tube locking rings 54 have internal threads that screw onto external threads on body connections 55. Each body connection 55 houses a ball valve 56 comprising an O-ring seal 57, a valve seat 58, and a valve ball 59. In the embodiment depicted, inlet tube 52 further includes a pair of mounts 60 for mounting the pump to a flat surface.

The pump further includes a shuttle valve 65, which is secured to pump core 15 with two plastic screws 67. Shuttle valve 65 receives a supply of compressed air through an air inlet 68. As is known in the art, shuttle valve 65 switches the supply of compressed air alternately from one side of the pump to the other to drive the pump.

The action of the pump can best be understood by referring to FIG. 2. The supply of compressed air will first be connected to pressure chamber 40 defined by the interior of driven member 30 on one side of the pump. Assume that the air pressure is applied first to the left driven member. As end cap 32 of driven member 30 is driven outward, the left bellows will expand and the right bellows will contract as the right driven member is pulled inward by pump shaft 20.

Withdrawal of the right driven member from the interior of right body member 45 creates a vacuum within the pumping chamber 70 on the right side of the pump. Valve ball 59 on the upper right of the pump seals against valve seat 58 to close off outlet tube 50 from right pumping chamber 71. At the same time, pumped fluid is drawn from inlet tube 52 into the right pumping chamber 71 through the valve on the lower right side of the pump.

When the left driven member is fully extended into left pumping chamber 72, the shuttle slides inside the shuttle valve thereby switching the supply of compressed air to right pressure chamber 40. Driven member 30 on the right side of the pump is pushed into right pumping chamber 71 simultaneously compressing the left driven member. The fluid in right pumping chamber 71 is pushed out into outlet tube 50 through the ball valve on the upper right side of the pump while the ball valve on the lower right closes off inlet tube 52. Simultaneously, a new volume of fluid is drawn from inlet tube 52 into left pumping chamber 72. Air in the left pressure chamber is exhausted out the back side of pump core 15. One or more mufflers 75 (FIG. 1) are typically used to control noise from compressed air exiting the back side of the pump. Pumping continues in this fashion with fluid being alternately drawn into and exhausted from the left and right pumping chambers in sequence.

The dual chamber bellows pump described herein is superior to known dual diaphragm pumps in a number of important ways. First, one expansion of the bellows on the driven member pumps much more fluid than does a single flexure of a diaphragm used in a prior art pump of equivalent size. This means that, for a given flow rate, the reciprocation frequency of pump shaft 20 through pump core 15 can be correspondingly less. O-rings 22 (FIG. 2) around pump shaft 20 wear more slowly than in previous designs and less frequent maintenance is required. A corresponding decrease in wear is experienced by ball valves 56 and shuttle valve 65, which also reciprocate at a lower frequency. Additionally, pressure variation in the pumped fluid is of lower frequency and amplitude than in a diaphragm pump of similar capacity.

Another important benefit is provided by the pump design described herein. The pump is constructed according to a simple design using a small number of easily assembled parts. Outlet and inlet tubes 50 and 52 including ball valves 56, body members 45, and driven members 30 can all be removed from pump core 15 without using tools. A screwdriver is the only tool needed to completely disassemble the pump. Assembly and disassembly of the pump is not complicated by large numbers of small clamps and fittings as in previous designs.

Furthermore, the high strength of the pump's connections makes it practical to manufacture the pump entirely of corrosion-resistant materials. As discussed above, this will be of paramount importance in highly demanding applications particularly in the semiconductor industry. In comparison with previous designs, no metal clamps are needed to secure the body members or inlet and outlet tubes to the pump-rotatable body rings 18 can be provided With large threads or an alternative fastening mechanism of sufficient strength. Similarly, large threads can be used on tube locking rings 54.

In an exemplary embodiment, pump body members 45, inlet tube 52, and outlet tube 50 are formed of perfluoroalcoxy (PFA). Valve seats 58, valve balls 59, and driven members 30 are made of polytetrafluoroethylene (PTFE). Body rings 18, pump core 15, and back plates 25 are formed of polyvinylidene fluoride (PVDF). Pump shaft 20 is molded from polyetherketone (PEEK). Finally, the various O-rings 22, 38, 47, and 57 are formed from a fluorinated ethylene-propylene copolymer (FEP). Of course, a number of materials combining the desired corrosion resistance with sufficient mechanical strength and formability may be substituted for the exemplary materials described above.

One embodiment of a pump according to the present invention has been described in considerable detail. However, modifications to this design may be made without departing from the principles of the invention. In particular, it should be noted that the method of securing the body members to the pump core by means of rotatable body rings could find use even in a dual diaphragm pump. Furthermore, the pump's simple, easily disassembled design would be useful even in a conventional pump constructed of metal. Therefore, the embodiment described should be considered as a particularly preferred embodiment and the scope of the invention should be determined primarily with reference to the appended claims, along with the full scope of equivalents to which those claims are entitled.

What is claimed is:

1. A pump comprising:

a central core;

first and second body members connected to said central core, each having an interior at least a portion of which defines a first and a second pumping chamber respectively;

first and second driven members each including a deformable element disposed at least partially within a corresponding first and second pumping chamber respectively, said first and second driven members drivable between retracted and extended positions, and said deformable elements deformable in response thereto;

a fluid inlet and a fluid outlet in fluid communication with each of said first and second pumping chambers fluid inlet and outlet valves between respective fluid inlet and fluid outlets and the interior of each pump body member;

means operative to drive each of said first and second driven members alternately between its respective retracted and extended positions, whereby fluid is alternately drawn into one of said first and second pumping chambers and simultaneously expelled from the other through respective fluid inlets and fluid outlets;

all elements of said pump being of a formable, nonmetallic material which is resistant to chemical corrosion.

2. A pump according to claim 1 wherein said deformable elements comprise a bellow.

3. A pump according to claim 1 wherein said formable material comprises an organic polymer.

4. A pump according to claim 1 wherein said formable material comprises a fluorinated polymer.

5. A pump according to 1 wherein said formable material comprises a material selected from the group consisting of PFA, PTFE, PVDF, PEEK and FEP.

6. A pump according to claim 1 including connecting means for securely connecting and disconnecting said first and second body members and said central core manually without tools.

7. A pump according to claim 6 wherein said connecting means comprises a fastening ring.

8. A pump according to claim 7 wherein said fastening ring is rotatable for connecting and disconnecting said central core and said first and second body members.

9. A pump according to claim 8 wherein said fastening ring is rotatable around a central axis through said central core.

10. A pump according to claim 7 wherein said fastening ring includes a first structure and said first and second body members contain respective second structures adapted to interlock with said first structure.

11. A pump according to claim 10 wherein said first and second structures comprise thread means.

12. A pump according to claim 7 wherein said fastening ring is mounted to said central core.

13. A pump according to claim 7 including a plate for mounting said fastening ring to said central core.

14. A pump according to claim 1, further comprising:

a fluid inlet tube in communication with at least one of said first and second fluid inlets;

a fluid outlet tube in communication with at least one of said first and second fluid outlets; and at least one fastening ring for connecting at least one of said fluid inlet tubes with said fluid inlets and said fluid outlet tubes with said fluid outlets.

15. A pump according to claim 14 wherein said fastening ring comprises means for securely connecting and disconnecting said fluid inlet and fluid outlet tubes with respective fluid inlets and fluid outlets manually without tools.

16. A pump according to claim 14 wherein said fastening ring is rotatable for connecting and disconnecting said fluid inlet and fluid outlet tubes and respective fluid inlets and fluid outlets.

17. A pump according to claim 14 wherein said fastening ring includes a first structure and said first and second body members contain respective second structures adapted to interlock with said first structure.

18. A pump according to claim 17 wherein said first and second structures comprise thread means.

19. A pump according to claim 14 wherein said at least one fastening ring is mounted to at least one of said fluid inlet and fluid outlet tubes.

* * * * *